US009086662B2

(12) United States Patent
Okuzono

(10) Patent No.: US 9,086,662 B2
(45) Date of Patent: Jul. 21, 2015

(54) IMAGE FORMING APPARATUS THAT CONTROLS PRINT START TEMPERATURE OF FIXING SECTION, METHOD OF CONTROLLING THE SAME, AND STORAGE MEDIUM

(71) Applicant: CANON KABUSHIKI KAISHA, Tokyo (JP)

(72) Inventor: Ryotaro Okuzono, Kawasaki (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/079,696

(22) Filed: Nov. 14, 2013

(65) Prior Publication Data

US 2014/0133878 A1 May 15, 2014

(30) Foreign Application Priority Data

Nov. 15, 2012 (JP) ..... 2012-251262

(51) Int. Cl.
*G03G 15/20* (2006.01)

(52) U.S. Cl.
CPC ..... *G03G 15/2046* (2013.01); *G03G 15/2078* (2013.01)

(58) Field of Classification Search
CPC ..... G03G 15/2078; G03G 15/2046; H04N 1/00986; H04N 1/00978
USPC ..... 399/69, 8, 82, 67; 347/156; 358/1.15, 358/1.18; 430/124.3
See application file for complete search history.

(56) References Cited

U.S. PATENT DOCUMENTS

2008/0232838 A1* 9/2008 Cho ..... 399/69
2013/0084092 A1* 4/2013 Ooyanagi ..... 399/69
2013/0330097 A1* 12/2013 Collison et al. ..... 399/69

FOREIGN PATENT DOCUMENTS

JP 2005-094698 A 4/2005
JP 2008-216320 A 9/2008

OTHER PUBLICATIONS

Machine translation of JP 2008-216320 (publiched on Sep. 18, 2008).*

* cited by examiner

*Primary Examiner* — Sophia S Chen
(74) *Attorney, Agent, or Firm* — Rossi, Kimms & McDowell LLP

(57) ABSTRACT

An image forming apparatus capable of performing image formation quickly and reducing power consumption. The image forming apparatus includes an image forming unit that forms images by transferring toners to sheets and fixing the toners onto the sheets using a fixing section. A page count is acquired which is indicative of the number of pages on which image formation can be formed within a time period required before the temperature of the fixing section rises from a first temperature to a second temperature. Then, when it is determined that rendering of PDL data for pages in the page count is completed, if all of the pages in the page count are for the text images, the image forming unit is controlled such that printing is started when the temperature of the fixing section has reached the first temperature.

6 Claims, 6 Drawing Sheets

IMAGE FORMING APPARATUS THAT CONTROLS PRINT START TEMPERATURE OF FIXING SECTION, METHOD OF CONTROLLING THE SAME, AND STORAGE MEDIUM

BACKGROUND OF THE INVENTION

1. Field of the Invention

The present invention relates to an image forming apparatus that controls a print start temperature of a fixing section, a method of controlling the image forming apparatus, and a storage medium.

2. Description of the Related Art

Conventionally, in an image forming apparatus which performs image formation by heating and fixing a toner image formed by an electrophotographic method onto a recording medium, the fixing temperature of a fixing device is set to a predetermined temperature, and the amount of heat for fixing is set such that sufficient fixability is obtained even when a maximum amount of toner is applied to the recording medium.

Therefore, when printing of an image of an original, such as a text original, which requires application of a small amount of toner, is executed, it is necessary to warm up the fixing device to the predetermined fixing temperature in spite of the fact that the original image can be fixed at a lower temperature than the predetermined fixing temperature.

In such a case, the fixing device suffers from power loss and it is required to wait for a long time period before the fixing device is warmed up to the predetermined fixing temperature. To eliminate this inconvenience, there have been proposed various kinds of improvement.

For example, there has been proposed a technique in which before image data is generated from an original, it is determined in advance based on a print mode specified from outside whether the mode of image formation is a monochrome printing mode or a color printing mode (see e.g. Japanese Patent Laid-Open Publication No. 2005-94698).

In Japanese Patent Laid-Open Publication No. 2005-94698, a color image-forming system is disclosed which shortens the time period required to wait at the print start time by switching, before image data starts to be generated from an original, recording material conveyance control and fixing temperature control.

Further, an image forming apparatus has been proposed which decides, based on a description concerning designation of a color mode, one of a time when monochrome printing becomes executable and a time when color printing becomes executable, as a print start time (see e.g. Japanese Patent Laid-Open Publication No. 2008-216320).

As described above, in the conventional technique, it is judged based on the contents of a print job whether printing to be executed is monochrome printing or color printing, and printing is started by switching operations of a printer for the fixing temperature control and the like.

However, even in monochrome printing, it is required to set a rather high fixing temperature so as to print a wide range of originals from text originals, printing of which requires application of small amounts of toner, to image originals, such as originals of graphics and photographs, printing of which requires application of large amounts of toner.

For this reason, when printing of text originals, which requires application of a small amount of toner, is to be executed, the conventional technique suffers from the problems of power loss at the fixing device and a long waiting time period before the fixing device is warmed up to the fixing temperature.

SUMMARY OF THE INVENTION

The present invention provides an image forming apparatus that controls a print start temperature of a fixing section such that it is possible not only to perform image formation quickly but also to reduce power consumption, a method of controlling the image forming apparatus, and a storage medium.

In a first aspect of the present invention, there is provided an image forming apparatus including an image forming unit that forms an image by transferring a color material to a recording medium and fixing the color material onto the recording medium using a fixing section, comprising an acquisition unit configured to, when the fixing section is to be heated, acquire an image formation executable number indicative of the number of pages on which image formation can be performed within a time period required for a temperature of the fixing section to rise from a first temperature which makes it possible to form text images representing only text to a second temperature which is higher than the first temperature and makes it possible to form graphic images including images other than the text images, a determination unit configured to, when a document formed by a plurality of pages is to be printed, determine whether or not all of the image formation executable number of pages, starting from a leading page, on which image formation is to be performed, are for the text images, and a control unit configured to, when it is determined by the determination unit that all of the image formation executable number of pages are for the text images, control the image forming unit such that printing is started when the temperature of the fixing section has reached the first temperature.

In a second aspect of the present invention, there is provided a method of controlling an image forming apparatus including an image forming unit that forms an image by transferring a color material to a recording medium and fixing the color material onto the recording medium using a fixing section, comprising acquiring, when the fixing section is to be heated, an image formation executable number indicative of the number of pages on which image formation can be performed within a time period required for a temperature of the fixing section to rise from a first temperature which makes it possible to form text images representing only text to a second temperature which is higher than the first temperature and makes it possible to form graphic images including images other than the text images, determining, when a document formed by a plurality of pages is to be printed, whether or not all of the image formation executable number of pages, starting from a leading page, on which image formation is to be performed, are for the text images, and controlling, when it is determined by the determining that all of the image formation executable number of pages are for the text images, the image forming unit such that printing is started when the temperature of the fixing section has reached the first temperature.

In a third aspect of the present invention, there is provided a non-transitory computer-readable storage device storing a computer-executable program for causing a computer to execute a method of controlling an image forming apparatus including an image forming unit that forms an image by transferring a color material to a recording medium and fixing the color material onto the recording medium using a fixing section, wherein the method comprises acquiring, when the fixing section is to be heated, an image formation executable number indicative of the number of pages on which image formation can be performed within a time period required for a temperature of the fixing section to rise from a first temperature which makes it possible to form text images representing only text to a second temperature which is higher than the first temperature and makes it possible to form graphic images including images other than the text images, determining, when a document formed by a plurality of pages is to be printed, whether or not all of the image formation executable number of pages, starting from a leading page, on which image formation is to be performed, are for the text images, and controlling, when it is determined by the determining that all of the image formation executable number of pages are for the text images, the image forming unit such that printing is started when the temperature of the fixing section has reached the first temperature.

According to the present invention, it is possible to provide an image forming apparatus which is capable of not only performing image formation quickly but also reducing power consumption, a method of controlling the image forming apparatus, and a storage medium.

Further features of the present invention will become apparent from the following description of exemplary embodiments with reference to the attached drawings.

DESCRIPTION OF THE EMBODIMENTS

The present invention will now be described in detail below with reference to the accompanying drawings showing embodiments thereof.

Figure 1:
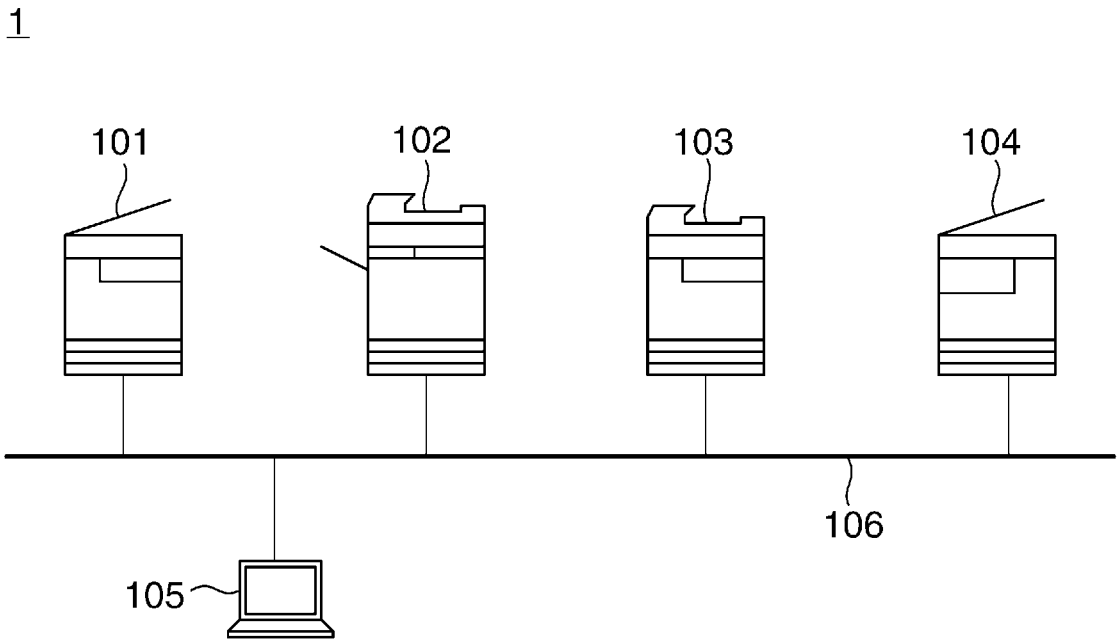
FIG. 1 is a schematic diagram of an image forming system including image forming apparatuses (MFPs) according to an embodiment of the present invention.

FIG. 1 is a schematic diagram of an image forming system including image forming apparatuses according to an embodiment of the present invention.

Referring to FIG. 1, the image forming system 1 comprises the image forming apparatuses, denoted by reference numerals 101, 102, 103, and 104, and a personal computer (hereinafter referred to as the "PC") 105, which are connected to a network 106. In the following description, the image forming apparatuses are referred to as MFPs (multifunctional peripherals). The MFPs 101, 102, 103, and 104 have the same construction and the same functions, and hence the MFP 101 will be described as an example unless a particular distinction is made. Further, in the following description, a recording medium is sometimes referred to as a sheet, and formation of an image is sometimes referred to as printing.

The network 106 is a local area network (LAN), and it does not matter whether the LAN is wired or wireless.

The PC 105 is a general computer which includes a CPU, a RAM, and a fixed storage device, such as an HDD, and to which are connected a monitor, a keyboard, a mouse, and so forth. The PC 105 has a printer section driver program installed therein as an image forming program.

When the printer section driver program is executed, the PC 105 generates PDL data based on image drawing commands issued by an operating system or an application program, and transmits the PDL data to one of the MFPs 101, 102, 103, and 104.

Here, the term "PDL data" refers to data formed by converting the image drawing commands to a page description language which is processable by the MFPs 101, 102, 103, and 104, according to the printer section driver program.

The MFPs 101, 102, 103, and 104 each print a bitmap image generated based on the PDL data received from the PC 105 on a sheet.

Figure 2:
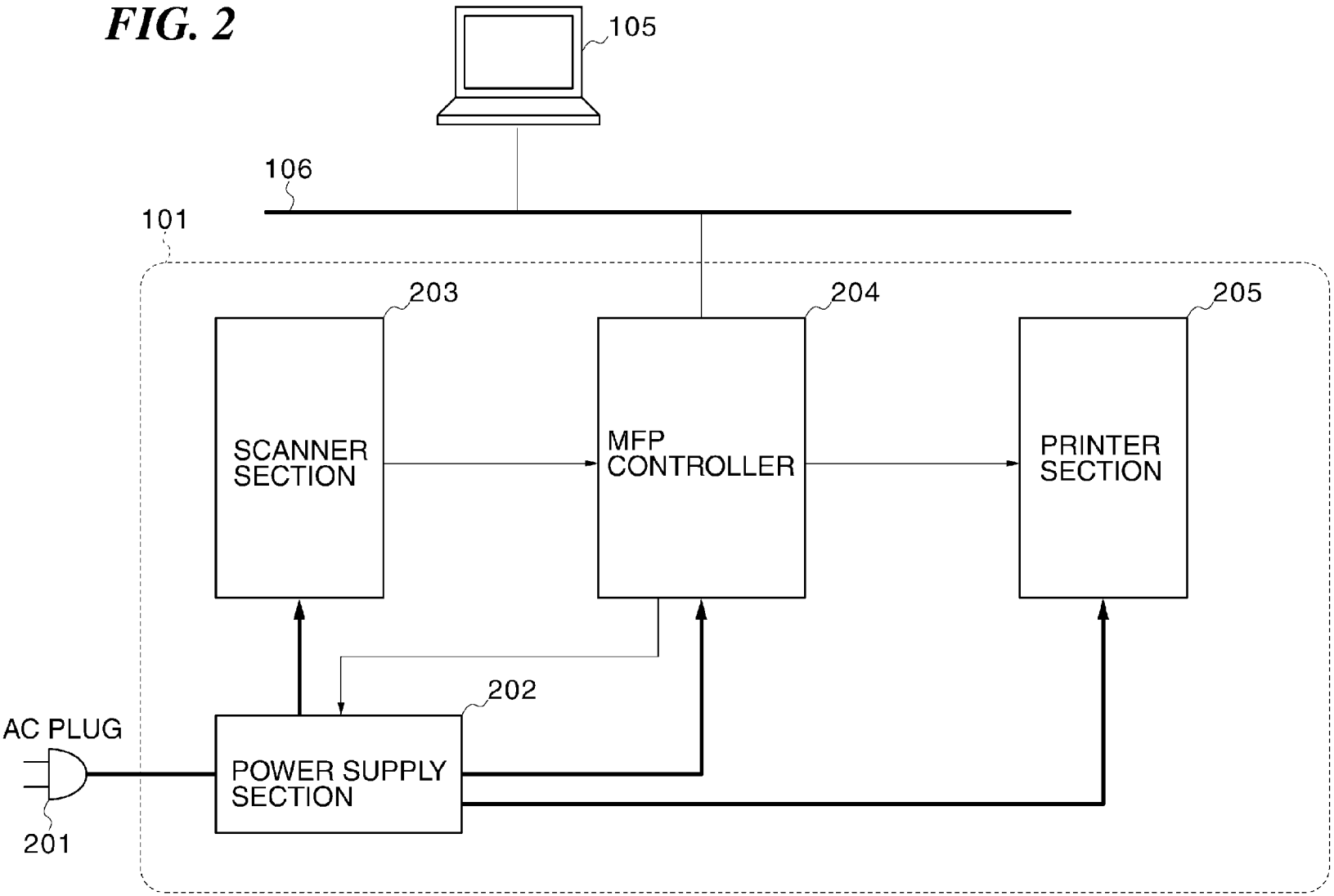
FIG. 2 is a schematic diagram of an MFP appearing in FIG. 1.

FIG. 2 is a schematic diagram of the MFP 101 appearing in FIG. 1.

Referring to FIG. 2, the MFP 101 comprises an MFP controller 204, a scanner section 203, a printer section 205, a power supply section 202, and an AC plug 201.

The MFP controller 204 controls the overall operation of the MFP 101. Specifically, the MFP controller 204 performs control for transmitting and receiving packets to and from the network 106, converting PDL data received from the PC 105 to bitmap images, printing the bitmap images by the printer section 205, and so forth.

The scanner section 203 optically reads an image from an original, and converts the image to a digital image. The printer section 205 performs printing on a recording medium, such as a recording sheet, e.g. by an electrophotographic method.

When the AC plug 201 is inserted into an electrical socket outside the MFP 101 to supply power from an AC commercial power supply, the power supply section 202 supplies DC power to the component devices of the MFP 101.

Figure 3:
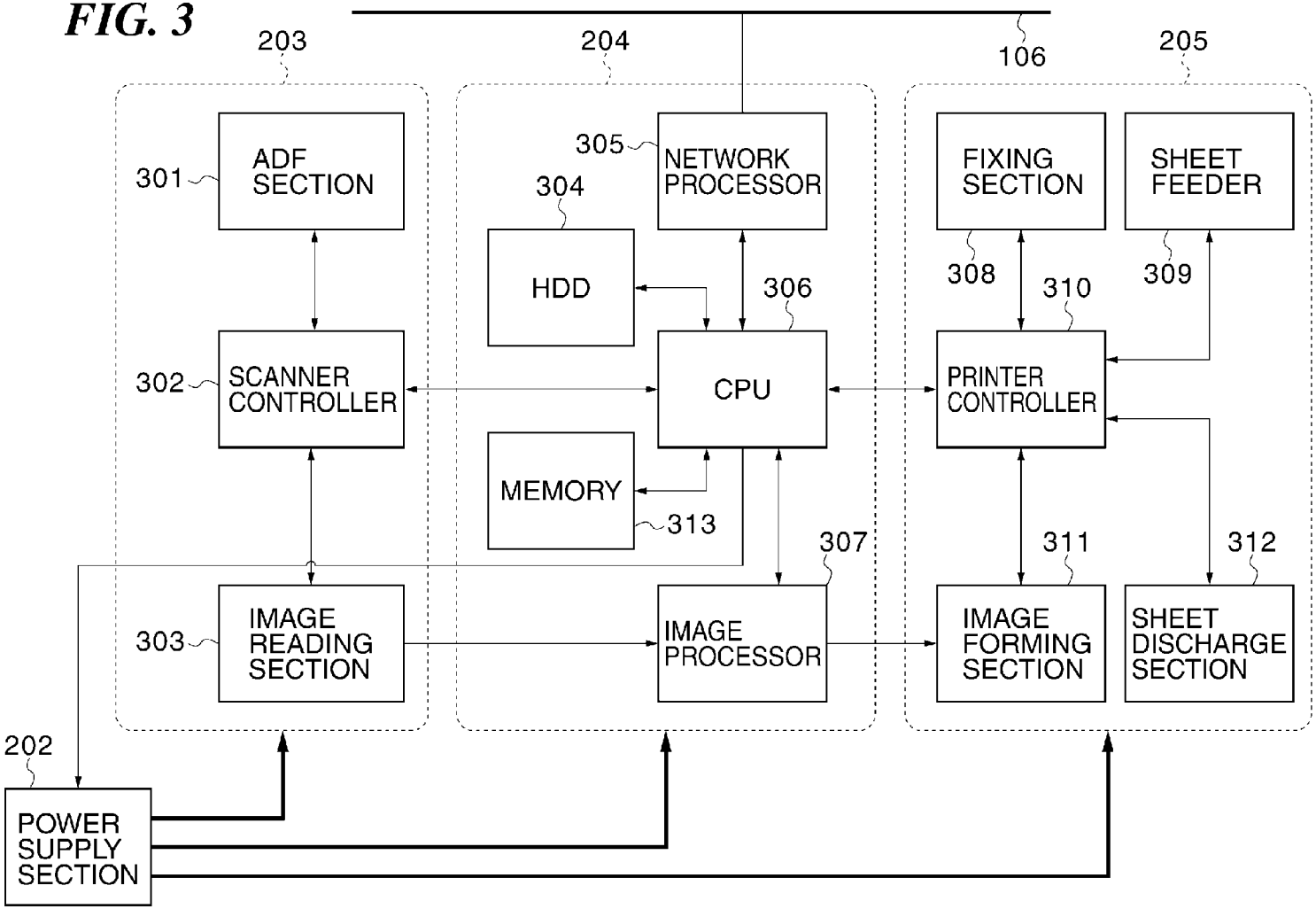
FIG. 3 is a schematic diagram of an MFP controller, a scanner section, and a printer section shown in FIG. 2.

FIG. 3 is a schematic diagram of the MFP controller 204, the scanner section 203, and the printer section 205 shown in FIG. 2.

Referring to FIG. 3, the scanner section 203 includes an ADF (automatic document feeder) section 301, a scanner controller 302, and an image reading section 303.

The scanner controller 302 communicates with a CPU 306 of the MFP controller 204, and controls the operations of the ADF section 301 and the image reading section 303 according to control commands from the CPU 306.

The ADF section 301 sequentially conveys a plurality of originals set on a document tray one by one to the image reading section 303. The image reading section 303 optically reads image information, such as photographs, text, and graphics, from the originals, and outputs the read image information to an image processor 307 of the MFP controller 204 as digital images.

The MFP controller 204 includes a network processor 305, an HDD 304, the CPU 306, the image processor 307, and a memory 313.

The network processor 305 inputs PDL data transmitted from the PC 105 via the network 106, to the CPU 306. The HDD 304 stores programs executed by the CPU 306, and temporarily stores the PDL data transmitted via the network 106.

The CPU 306 is a central processing unit that controls the overall operation of the MFP 101. Further, the CPU 306 also performs e.g. processing for analyzing the PDL data sent from the network processor 305 to generate a display list which is in a data format which the image processor 307 can convert to bitmap data.

The memory 313 is a volatile memory, such as a DDR SDRAM (double-data-rate synchronous dynamic random access memory), and is used as a main memory that stores user data and the like created e.g. by the application program executed by the CPU 306.

The image processor 307 analyzes the display list generated by the CPU 306, converts the same to bitmap data, and outputs the bitmap data to an image forming section 311 of the printer section 205. Further, when analyzing the display list input from the CPU 306, the image processor 307 is capable of determining whether or not image data is included and whether or not color data is included in pages of the display list. Furthermore, the image processor 307 performs image processing, such as color space conversion, on a digital image output from the image reading section 303, converts the digital image to bitmap data, and outputs the same to the image forming section 311 of the printer section 205.

The printer section 205 comprises a printer controller 310, a fixing section 308, a sheet feeder 309, the image forming section 311, and a sheet discharge section 312. The printer section 205 corresponds to an image forming unit that forms an image by transferring a color material to a recording medium and fixing the color material onto the recording medium using a fixing section.

The printer controller 310 communicates with the CPU 306 of the MFP controller 204, and controls the operations of the fixing section 308, the sheet feeder 309, the image forming section 311, and the sheet discharge section 312, according to control commands from the CPU 306.

When the bitmap data is input to the image forming section 311 from the image processor 307, the image forming section 311 prints toner (color material) images on a sheet based on the bitmap data.

If the MFP 101 is capable of performing color printing, the image forming section 311 forms toner images using toners of four colors (cyan, magenta, yellow, and black). If the MFP 101 can perform only monochrome printing, the image forming section 311 forms a toner image using a toner of a single color (black).

The temperature of the fixing section 308 is adjusted to a predetermined preset temperature by a heater, not shown, and the fixing section 308 heats and presses the toner image printed on the sheet to thereby fix the toner image onto the sheet.

The sheet feeder 309 stores sheets, and supplies the stored sheets one by one to the image forming section 311. The sheet discharge section 312 discharges sheets having respective toner images fixed thereon by the fixing section 308.

In the above-described construction of the MFP 101, to reduce power consumption of the MFP 101, if no instruction for a printing operation is given for a predetermined time period, the MFP 101 is switched from a state where printing can be immediately started (hereinafter referred to as the "standby mode") to a state where it takes time to start printing and the power consumption of the MFP 101 is smaller than in the standby mode (hereinafter referred to as the "power saving mode").

In the power saving mode, to reduce the power consumption of the MFP 101, power supply to the scanner section 203 and the printer section 205 is cut off.

When no instruction for a printing operation has been given for a predetermined time period, the standby mode is shifted to the power saving mode by the CPU 306 which instructs the power supply section 202 to cut off the power supply to the scanner section 203 and the printer section 205.

On the other hand, upon detecting reception of PDL data e.g. from the PC 105 connected to the network 106, the power saving mode is shifted to the standby mode, by the CPU 306 which instructs the power supply section 202 to supply power to the printer section 205.

In the standby mode, the temperature of the fixing section 308 is controlled to an optimum temperature for fusing toner.

On the other hand, in the power saving mode, since the power supply to the printer section 205 is cut off, the temperature of the fixing section 308 is lowered with the lapse of time.

When the temperature of the fixing section 308 is lowered, it takes a certain time period before the temperature of the fixing section 308 restores the optimum temperature for fusing toner next. Therefore, even after return from the power saving mode has been instructed, it takes a predetermined time period before completion of switching from the power saving mode to the standby mode in which the MFP 101 is ready for printing.

Figure 4A:
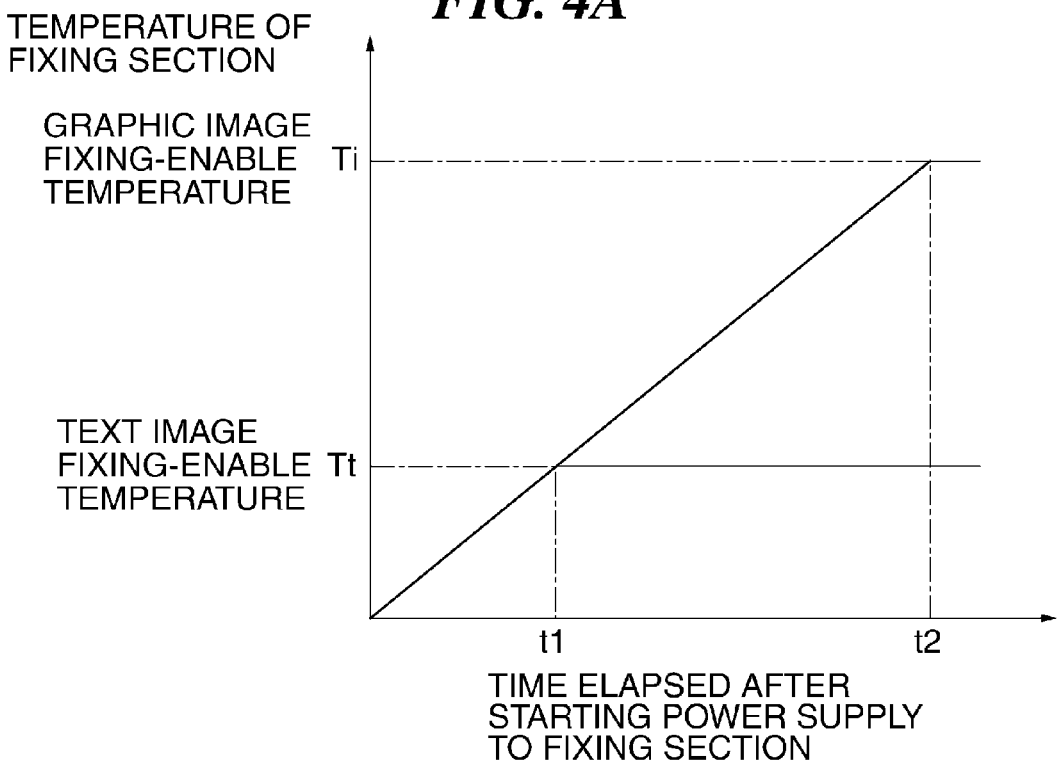
FIGS. 4A and 4B are diagrams each showing a correspondence relationship between a time period elapsed after power supply to a fixing section is started and the temperature of the fixing section.
Figure 4B:
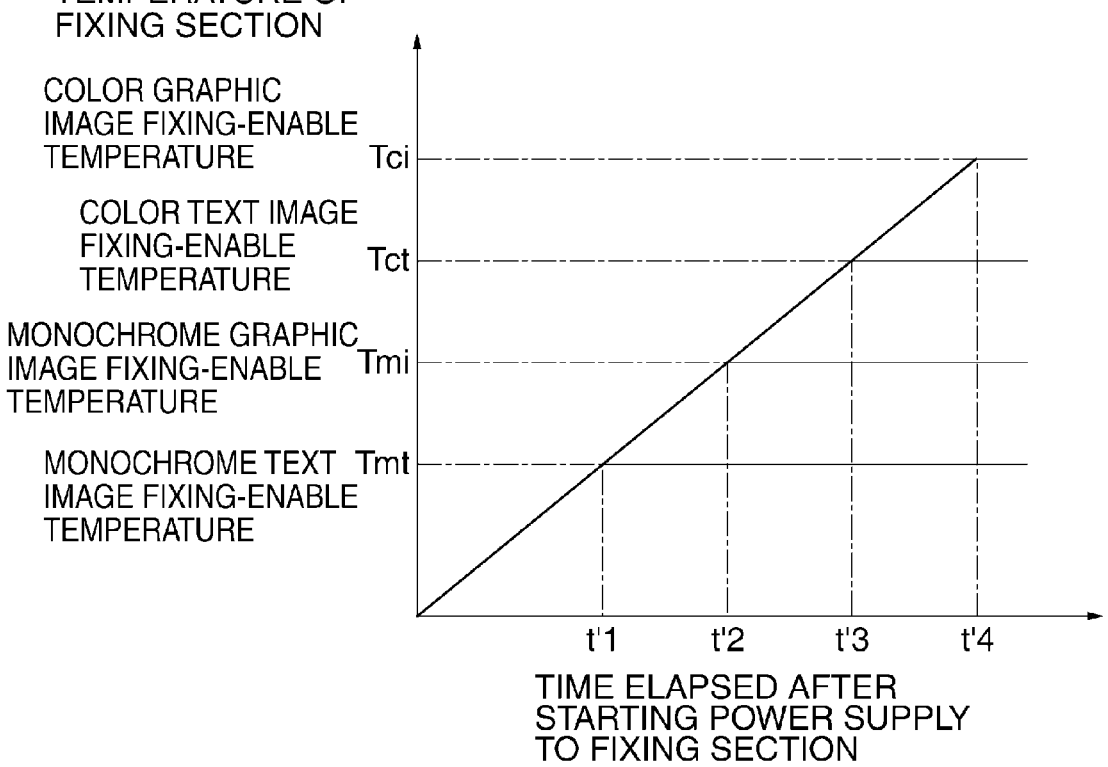

FIGS. 4A and 4B are diagrams each showing a correspondence relationship between time elapsed after power supply to the fixing section 308 is started and the temperature of the fixing section 308.

FIG. 4A is a diagram showing a correspondence relationship between the time and the temperature in a case where the MFP 101 can perform only monochrome printing.

Referring to FIG. 4A, when a time period t1, which is required for the temperature of the fixing section 308 to reach a temperature Tt (text image fixing-enable temperature), has elapsed after power supply to the fixing section 308 is started e.g. due to return from the power saving mode, it becomes possible to perform a fixing operation provided that the original is a text original requiring application of a small amount of toner.

Further, when a time period t2, which is required for the temperature of the fixing section 308 to reach a temperature Ti (graphic image fixing-enable temperature), has elapsed, it becomes possible to perform a fixing operation, even when the original is an image original, such as graphics or a photograph, which requires application of a large amount of toner.

That is, if the original for printing is a text original, there is no need to wait until the lapse of the time period t2, which is required for the temperature of the fixing section 308 to reach the temperature Ti, and therefore it is possible to start printing of the original a time period (t2-t1) earlier. Further, if the original for printing is a text original, there is no need to warm up the fixing section 308 to the temperature Ti, and hence it is possible to reduce the power consumption of the MFP 101.

FIG. 4B is a diagram showing a correspondence relationship between the time and the temperature in a case where the MFP 101 can perform color printing.

Referring to FIG. 4B, when a time period t'1, which is required for the temperature of the fixing section 308 to reach a temperature Tmt (monochrome text image fixing-enable temperature), has elapsed after power supply to the fixing section 308 is started e.g. due to return of the MFP 101 from the power saving mode, it becomes possible to perform a fixing operation, provided that the original is a text original of a monochrome page which requires application of a small amount of toner.

Further, when a time period t'2, which is required for the temperature of the fixing section 308 to reach a temperature Tmi (monochrome graphic image fixing-enable temperature), has elapsed, it becomes possible to perform a fixing operation, even for an original of a monochrome image.

Furthermore, when a time period t'3, which is required for the temperature of the fixing section 308 to reach a temperature Tct (color text image fixing-enable temperature), has elapsed, it becomes possible to perform a fixing operation, even for an original of a color page provided that the original is a text original which requires application of a small amount of toner.

Further, when a time period t'4, which is required for the temperature of the fixing section 308 to reach a temperature Tci (color graphic image fixing-enable temperature), has elapsed, it becomes possible to perform a fixing operation, for any page of color or monochrome.

Therefore, if the original for printing is a monochrome text original, there is no need to wait until the lapse of the time period t'4, which is required for the temperature of the fixing section 308 to reach the color graphic image fixing-enable temperature Tci which makes it possible to fix color images, and hence it is possible to start printing of the original a time period (t'4-t'1) earlier.

Further, if the original for printing is a monochrome text original, there is no need to warm up the fixing section 308 to a higher temperature than the monochrome text image-fixing enable temperature Tmt, which makes it possible to reduce the power consumption of the MFP 101.

In FIGS. 4A and 4B, the above-mentioned temperatures Tt and Tmt correspond to a first temperature which makes it possible to form text images representing only text. Further, the above-mentioned temperatures Ti and Tmi correspond to a second temperature which is higher than the first temperature and makes it possible to form graphic images including images other than text images.

Furthermore, the color text image fixing-enable temperature Tct corresponds to a third temperature which makes it possible to form color text images representing only color text. The color graphic image fixing-enable temperature Tci corresponds to a fourth temperature which makes it possible to form color graphic images including color images other than text images. Further, the temperatures Tt, Tmt, Ti, Tmi, Tct, and Tci are in the relationship of Tt, Tmt<Ti, and Tmi<Tct<Tci.

Figure 5:
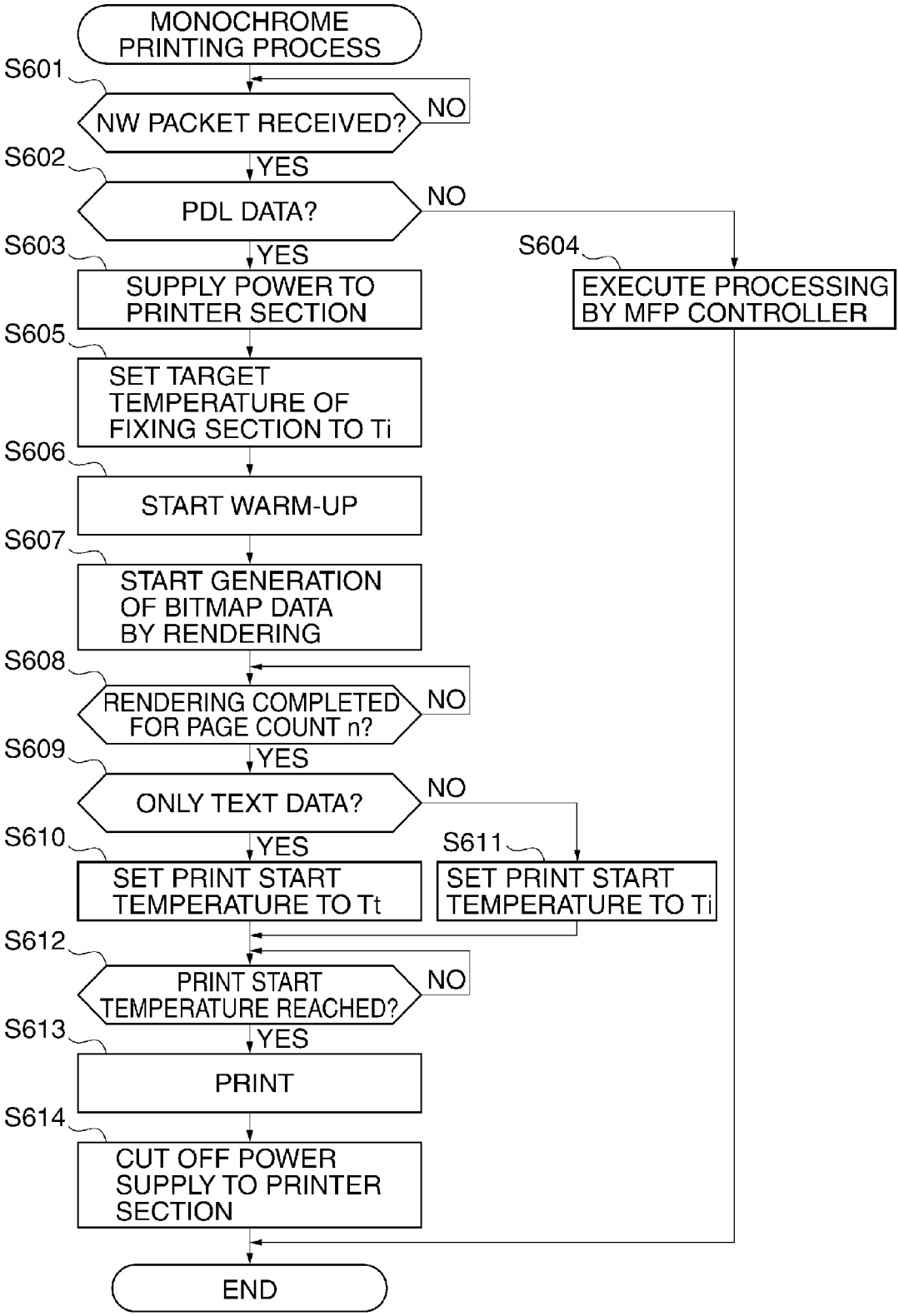
FIG. 5 is a flowchart of a monochrome printing process executed by the MFP controller appearing in FIG. 3.

FIG. 5 is a flowchart of a monochrome printing process executed by the MFP controller 204 appearing in FIG. 3.

The monochrome printing process shown in FIG. 5 is executed for printing a document formed by a plurality of pages when the MFP 101 is capable of performing only monochrome printing.

Referring to FIG. 5, in the power saving mode of the MFP 101, when the network processor 305 receives a network packet addressed to the MFP 101 via the network 106 (YES to a step S601), the network processor 305 inputs the received network packet to the CPU 306.

The CPU 306 determines whether or not the network packet is PDL data (step S602)

If it is determined in the step S602 that the network packet is not PDL data (No to the step S602), it means that the packet is not a request for printing but an inquiry from the PC 105 about model information of the MFP 101 or a like request.

Therefore, the MFP controller 204 executes a process for answering the inquiry e.g. about the model information from the PC 105 (step S604), followed by terminating the present process. After termination of the process, the CPU 306 shifts to the power saving mode, and waits in the power saving mode until it receives a network packet addressed to the MFP 101 again.

On the other hand, if it is determined in the step S602 that the network packet is PDL data (YES to the step S602), the CPU 306 controls the power supply section 202 to supply power to the printer section 205 (step S603).

Then, the CPU 306 sets a target temperature of the fixing section 308 to the graphic image fixing-enable temperature Ti, via the printer controller 310 (step S605), and starts warm-up of the fixing section 308 (step S606).

The CPU 306 generates a display list from the PDL data in parallel with the warm-up operation of the fixing section 308, and transmits the display list to the image processor 307. Upon receipt of the display list, the image processor 307 starts generation of bitmap data by rendering the display list (step S607).

Next, when the generation of rendered bitmap data by the image processor 307 is completed for a predetermined page count n (YES to the step S608), the CPU 306 determines whether or not the rendered bitmap data is formed by only text data (step S609). The above-mentioned predetermined page count n will be described hereinafter.

If it is determined in the step S609 that the rendered bitmap data is not only text data (NO to the step S609), the CPU 306 sets a print start temperature, which is the temperature of the fixing section 308 at which printing is to be started, to the graphic image fixing-enable temperature Ti (step S611), and proceeds to a step S612. Accordingly, in this case, in the steps S611 and S612, and a S613, referred to hereinafter, when it is determined that at least part of an image formation executable number of pages is not for text images, the CPU 306 controls the printer section 205 such that printing is started when the temperature of the fixing section 308 has reached the second temperature.

On the other hand, if it is determined in the step S609 that the rendered bitmap data is formed by only text data (YES to the step S609), the CPU 306 sets the print start temperature to the text image fixing-enable temperature Tt (step S610).

Then, when the temperature of the fixing section 308 has reached the print start temperature (YES to the step S612), the CPU 306 executes printing (step S613), and cuts off power supply to the printer section 205 (step S614), followed by terminating the present process. After termination of the process, the CPU 306 shifts to the power saving mode, and waits in the power saving mode until it receives a network packet addressed to the MFP 101 again.

Note that the print start temperature used for determination in the above-described step S612 is the graphic image fixing-enable temperature Ti when the step S611 is executed, whereas when the step S611 is not executed, the print start temperature is the text image fixing-enable temperature Tt.

Further, the above-mentioned predetermined page count n, i.e. the predetermined number of pages for which the image processor 307 performs rendering of bitmap data is the number of pages which can be printed within a time period Tx required to raise the temperature of the fixing section 308 from the text image fixing-enable temperature Tt to the graphic image fixing-enable temperature Ti.

Specifically, in the case of the present monochrome printing process, the predetermined page count n is the number of pages calculated by an equation: $n=a\times Tx\div 60$, wherein "a" (m/s) represents the engine speed of the MFP 101, and Tx represents a predetermined time period, e.g. empirically determined in advance, which requires for the temperature of the fixing section 308 to rise from the text image fixing-enable temperature Tt to the graphic image fixing-enable temperature Ti.

In the monochrome printing process shown in FIG. 5, the page count n is set to the number of pages on which image formation can be performed within a time period required for the temperature of the fixing section 308 to rise from the first temperature to the second temperature. Further, the step S609 corresponds to an operation of an acquisition unit configured to acquire the page count n, and to an operation of a determination unit configured to determine whether or not all of an image formation executable number of pages, starting from a leading page, on which image formation is to be performed, are for text images. The steps S612 and S613 correspond to an operation of a control unit configured to control the image forming unit such that printing is started when the temperature of the fixing section has reached the first temperature.

According to the monochrome printing process described above with reference to FIG. 5, printing is started earlier than when the print start temperature is not set, and hence it is possible to perform printing more quickly and reduce power consumption, compared with the conventional technique.

Figure 6:
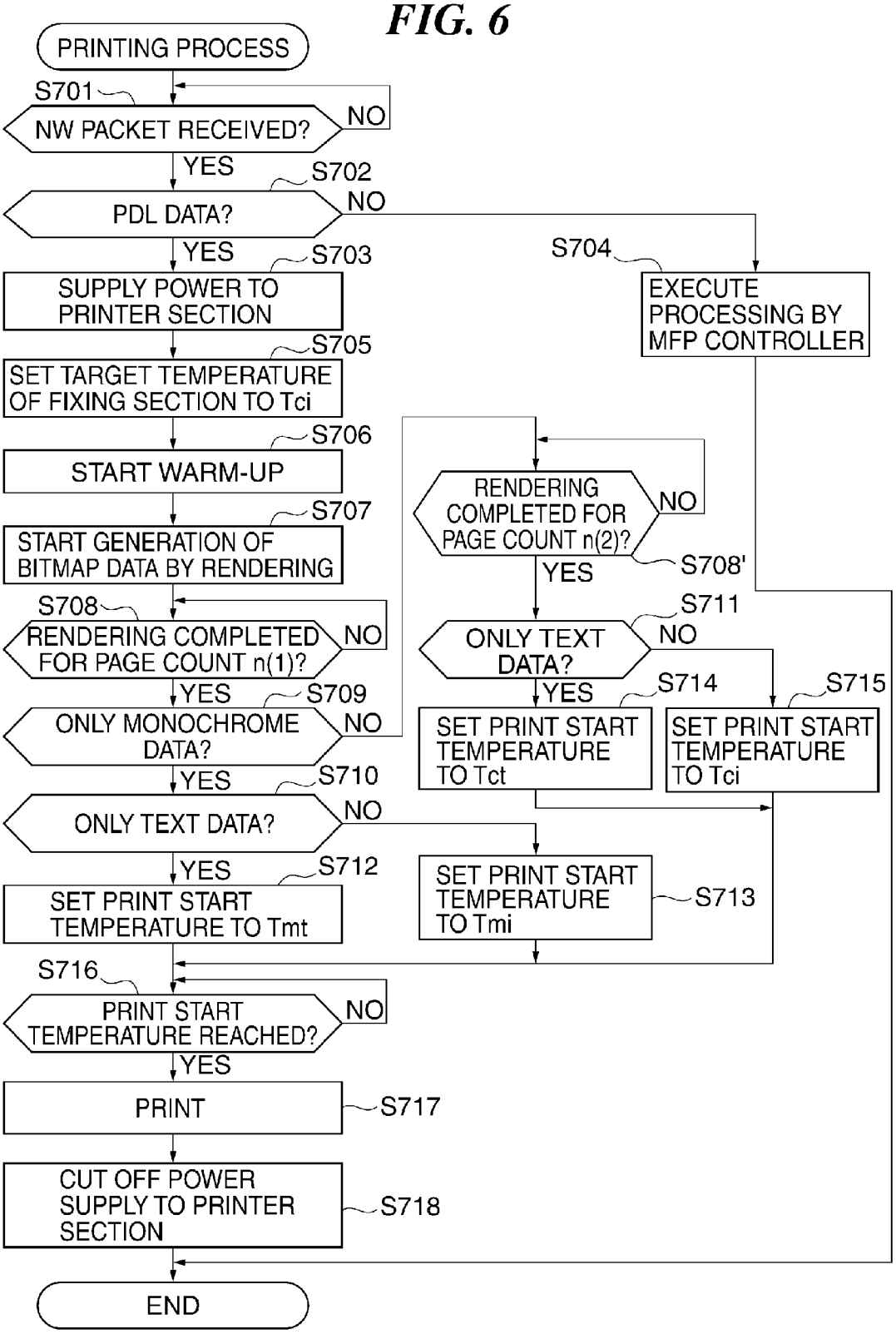
FIG. 6 is a flowchart of a printing process executed by the MFP controller appearing in FIG. 3.

FIG. 6 is a flowchart of a printing process executed by the MFP controller 204 shown in FIG. 3.

The printing process shown in FIG. 6 is executed for printing a document formed by a plurality of pages, and is executed in a case where the MFP 101 is capable of printing color images.

Referring to FIG. 6, in the power saving mode of the MFP 101, when the network processor 305 receives a network packet addressed to the MFP 101 via the network 106 (YES to a step S701), the network processor 305 inputs the received network packet to the CPU 306.

The CPU 306 determines whether or not the network packet is PDL data (step S702)

If it is determined in the step S702 that the network packet is not PDL data (No to the step S702), it means that the packet is not a request for printing but an inquiry from the PC 105 about model information of the MFP 101 or a like request.

Therefore, the MFP controller 204 executes a process for answering the inquiry e.g. about the model information from the PC 105 (step S704), followed by terminating the present process. After termination of the process, the CPU 306 shifts to the power saving mode, and waits in the power saving mode until it receives a network packet addressed to the MFP 101 again.

On the other hand, if it is determined in the step S702 that the network packet is PDL data (YES to the step S602), the CPU 306 controls the power supply section 202 to supply power to the printer section 205 (step S703).

Then, the CPU 306 sets the target temperature of the fixing section 308 to the color graphic image fixing-enable temperature Tci, via the printer controller 310 (step S705), and starts warm-up of the fixing section 308 (step S706).

The CPU 306 generates a display list from the PDL data in parallel with the warm-up operation of the fixing section 308, and transmits the display list to the image processor 307. Upon receipt of the display list, the image processor 307 starts execution of rendering of bitmap data based on the display list (step S707).

Next, the CPU 306 determines whether or not the rendering of bitmap data by the image processor 307 is completed for a predetermined page count n(1) (step S708). The predetermined page count n(1) in this case is an image formation executable number indicative of the number of pages on which image formation can be performed within a time period required for the temperature of the fixing section to rise from the monochrome text image-fixing enable temperature Tmt to the monochrome graphic image-fixing enable temperature Tmi. If it is determined in the step S708 that the rendering of bitmap data by the image processor 307 is completed for the predetermined page count n(1) (YES to the step S708), the CPU 306 determines whether or not the rendered bitmap data is formed by only monochrome data (step S709).

If it is determined in the step S709 that the rendered bitmap data is formed by only monochrome data (YES to the step S709), the CPU 306 determines whether or not the bit map data is formed by only text data (step S710).

If it is determined in the step S710 that the rendered bitmap data is formed only by text data (YES to the step S710), the CPU 306 sets the print start temperature to the monochrome text image-fixing enable temperature Tmt (step S712).

Then, when the temperature of the fixing section 308 has reached the print start temperature (YES to a step S716), the CPU 306 executes printing (step S717), and cuts off power supply to the printer section 205 (step S718), followed by terminating the present process. After termination of the process, the CPU 306 shifts to the power saving mode, and waits in the power saving mode until it receives a network packet addressed to the MFP 101 again. In this case, in the steps S716 and S717, the CPU 306 controls the printer section 205 such that printing is started when the temperature of the fixing section has reached the monochrome text image-fixing enable temperature Tmt.

Referring again to the step S710, if it is determined therein that the bit map data is not formed only by text data (NO to the step S710), the CPU 306 sets the print start time to the monochrome graphic image fixing-enable temperature Tmi (step S713), and then proceeds to the step S716. In this case, in the steps S716 and S717, the CPU 306 controls the printer section 205 such that printing is started when the temperature of the fixing section has reached the monochrome graphic image-fixing enable temperature Tmi.

Referring again to the step S709, if it is determined therein that the bit map data is not formed only by monochrome data (NO to the step S709), the CPU 306 determines whether or not the rendering of bitmap data by the image processor 307 is completed for a predetermined page count n(2) (step S708'). The predetermined page count n(2) in this case is an image formation executable number indicative of the number of pages on which image formation can be performed within a time period required for the temperature of the fixing section to rise from the color text image-fixing enable temperature Tct to the color graphic image-fixing enable temperature Tci. If it is determined in the step S708' that the rendering of bitmap data by the image processor 307 is completed for the predetermined page count n(2) (YES to the step S708'), the CPU 306 determines whether or not the rendered bitmap data is formed by only text data (step S711).

If it is determined in the step S711 that the rendered bit map data is formed by only text data (YES to the step S711), the CPU 306 sets the print start time to the color text image fixing-enable temperature Tct (step S714), and then proceeds to the step S716. In this case, in the steps S716 and S717, the CPU 306 controls the printer section 205 such that printing is started when the temperature of the fixing section has reached the color text image fixing-enable temperature Tct.

On the other hand, if it is determined in the step S711 that the rendered bit map data is not formed by only text data (NO to the step S711), the CPU 306 sets the print start time to the color graphic image fixing-enable temperature Tci (step S714), and then proceeds to the step S716. In this case, in the steps S716 and S717, the CPU 306 controls the printer section 205 such that printing is started when the temperature of the fixing section has reached the color graphic image fixing-enable temperature Tci.

According to the printing process described above with reference to FIG. 6, even in the case of color printing, printing is started earlier than when the print start temperature is not set, and hence it is possible to perform printing more quickly and reduce power consumption, compared with the conventional technique.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2012-251262 filed Nov. 15, 2012, which is hereby incorporated by reference herein in its entirety.

What is claimed is:

1. An image forming apparatus including an image forming unit that forms an image by transferring a color material to a recording medium and fixing the color material onto the recording medium using a fixing section, the image forming apparatus comprising:

a reception unit configured to receive a print job;

a warm-up unit configured to raise a temperature of the fixing section in a case where the reception unit receives the print job;

a generation unit configured to generate a plurality of pages of images to be formed on recording mediums;

a determination unit configured to, in a case where the generation unit generates predetermined pages of images, determine whether or not all of the predetermined pages of images are for text images; and a control unit configured to:

control, in a case where said determination unit determines that all of the predetermined pages of images are for the text images, the image forming unit so that printing starts when the temperature of the fixing section reaches a first temperature that enables formation of text images representing only text; and control, in a case where said determination unit determines that all of the predetermined pages of images are not for the text images, the image forming unit so that printing starts when the temperature of the fixing section reaches a second temperature, which is higher than the first temperature, that enables formation of graphic images, including images other than the text images.

2. The image forming apparatus according to claim 1, wherein:

in a case where said determination unit determines that all of the predetermined pages of images are color text images, the control unit controls the image forming unit so that printing starts when the temperature of the fixing section reaches a third temperature, which is higher than the first temperature, that enables formation of color text images representing only color text, and in a case where said determination unit determines that the predetermined pages of images include color graphic images other than a color text image, the control unit controls the image forming unit so that printing starts when the temperature of the fixing section reaches a fourth temperature, which is higher than the third temperature, that enables formation of a color graphic image.

3. The image forming apparatus according to claim 1, wherein said determination unit determines whether or not all of the predetermined pages of images are for the text images, using data formed by rendering PDL data indicative of images into bitmap data.

4. A method of controlling an image forming apparatus including an image forming unit that forms an image by transferring a color material to a recording medium and fixing the color material onto the recording medium using a fixing section, the method comprising:

a reception step of receiving a print job;

a warm-up step of raising a temperature of the fixing section in a case where the reception step receives the print job;

a generation step of generating a plurality of pages of images to be formed on recording mediums;

a determining step of determining, in a case where the generation step generates predetermined pages of images, whether or not all of the predetermined pages of images are for text images; and a controlling step of:

controlling, in a case where the determining step determines that all of the predetermined pages of images are for the text images, the image forming unit so that printing starts when the temperature of the fixing section reaches a first temperature that enables formation of text images representing only text; and controlling, in a case where the determination step determines that all of the predetermined pages of images are not for the text images, the image forming unit so that printing starts when the temperature of the fixing section reaches a second temperature, which is higher than the first temperature, that enables formation of graphic images, including images other than the text images.

5. The method according to claim 4, wherein:

in a case where the determination step determines that all of the predetermined pages of images are color text images, the controlling step controls the image forming unit so that printing starts when the temperature of the fixing section reaches a third temperature, which is higher than the first temperature, that enables formation of color text images representing only color text, and in a case where the determination step determines that the predetermined pages of images include color graphic images other than a color text image, the controlling step controls the image forming unit so that printing starts when the temperature of the fixing section reaches a fourth temperature, which is higher than the third temperature, that enables formation of a color graphic image.

6. A non-transitory computer-readable storage device storing a computer-executable program executable by a computer to execute a method of controlling an image forming apparatus including an image forming unit that forms an image by transferring a color material to a recording medium and fixing the color material onto the recording medium using a fixing section, the method comprising:

a reception step of receiving a print job;

a warm-up step of raising a temperature of the fixing section in a case where the reception step receives the print job;

a generation step of generating a plurality of pages of images to be formed on recording mediums;

a determining step of determining, in a case where the generation step generates predetermined pages of images, whether or not all of the predetermined pages of images are for text images; and a controlling step of:

controlling, in a case where the determining step determines that all of the predetermined pages of images are for the text images, the image forming unit so that printing starts when the temperature of the fixing section reaches a first temperature that enables formation of text images representing only text; and controlling, in a case where the determination step determines that all of the predetermined pages of images are not for the text images, the image forming unit so that printing starts when the temperature of the fixing section reaches a second temperature, which is higher than the first temperature, that enables formation of graphic images, including images other than the text images.

* * * * *